United States Patent [19]

Hone

[11] 4,002,385

[45] Jan. 11, 1977

[54] DOUBLE PULL DRAWER

[76] Inventor: Vernon R. Hone, Bridge Rte., Box 79A, Myrtle Point, Oreg. 97458

[22] Filed: Dec. 12, 1975

[21] Appl. No.: 640,007

[52] U.S. Cl. ..... 312/286; 312/348

[51] Int. Cl.[2] ..... A47B 81/00

[58] Field of Search ..... 312/286, 301, 309, 330, 312/337, 341

[56] References Cited

UNITED STATES PATENTS

| | | | |
|---|---|---|---|
| 128,439 | 6/1872 | Unna | 312/204 |
| 764,923 | 7/1904 | Canio | 312/337 |
| 1,021,722 | 3/1912 | McIntire | 312/337 |
| 1,147,998 | 7/1915 | Anderson | 312/204 |
| 1,329,510 | 2/1920 | Canio | 312/337 |
| 1,363,687 | 12/1920 | Sorg | 312/337 |
| 1,684,889 | 9/1928 | Russ | 312/286 |
| 2,716,046 | 8/1955 | Minturn | 312/286 |
| 3,465,897 | 9/1969 | Schumann et al. | 312/286 |

*Primary Examiner*—Paul R. Gilliam
*Assistant Examiner*—J. Sakran
*Attorney, Agent, or Firm*—Lee R. Schermerhorn

[57] ABSTRACT

A drawer arranged to be pulled out from opposite sides of a cabinet contains a receptacle half the length of the drawer. A transverse roller is mounted in an opening at mid length in the bottom of the drawer to roll on the bottom of the drawer compartment in the cabinet. The receptacle rides on the roller whereby the receptacle is moved toward the outer end of the drawer when the drawer is opened, regardless of the direction in which the drawer is pulled out of the cabinet.

10 Claims, 3 Drawing Figures

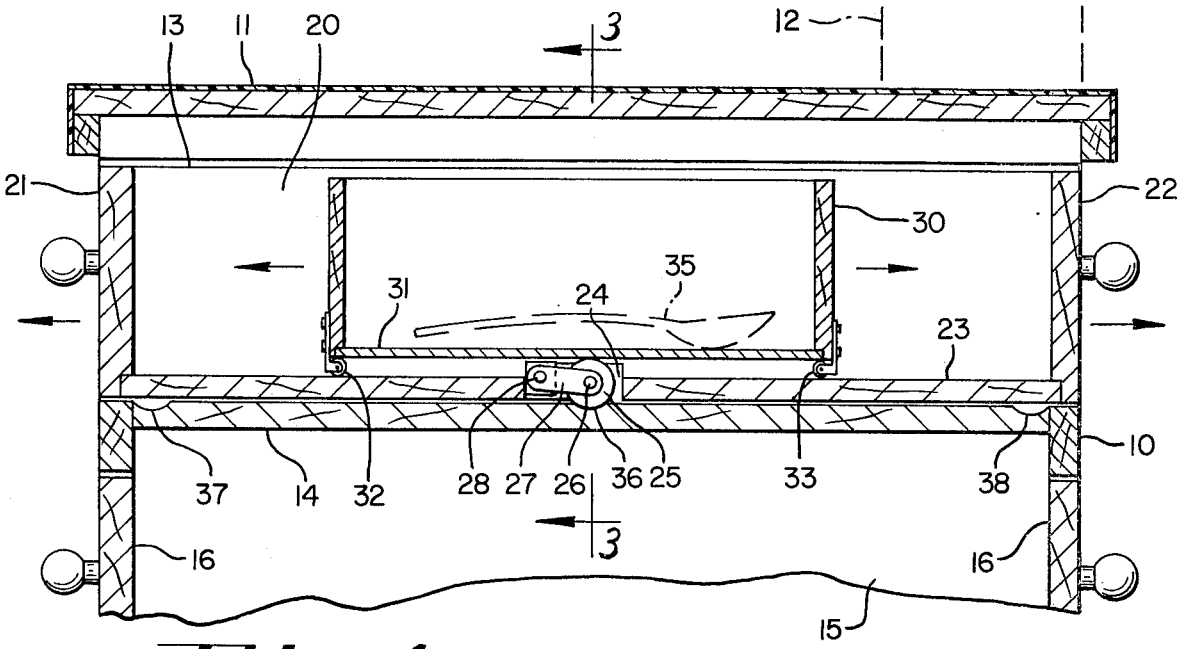
Fig 1
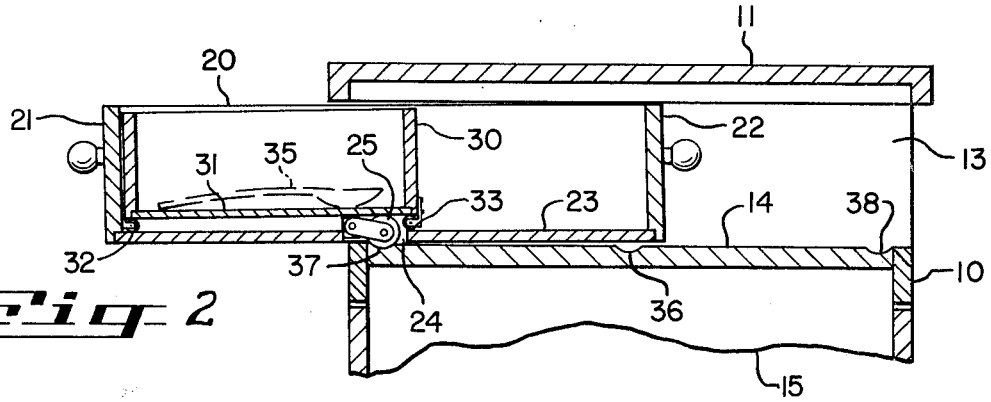
Fig 2
Fig 3
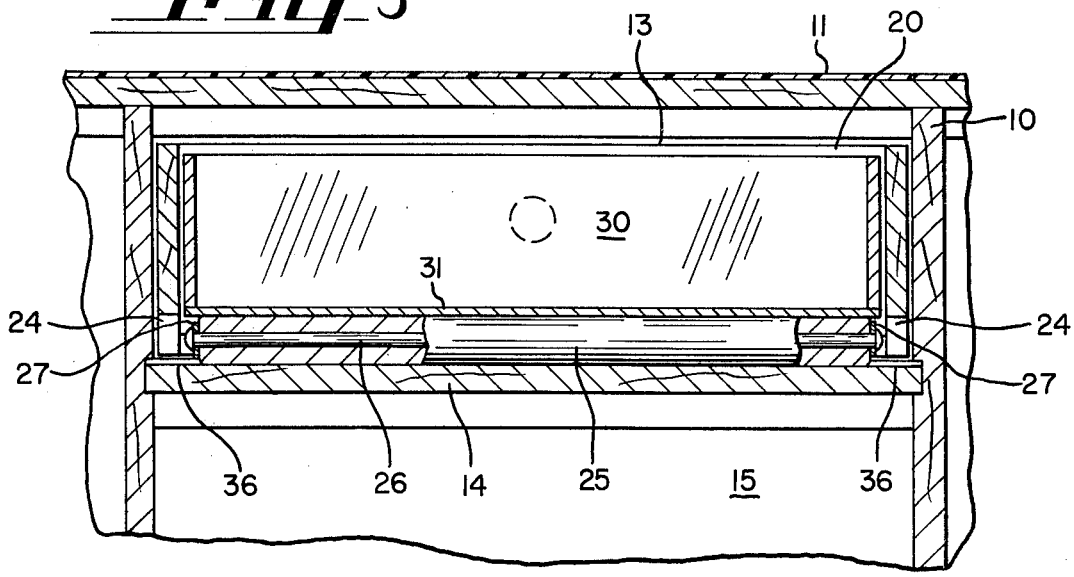

DOUBLE PULL DRAWER

BACKGROUND OF THE INVENTION

This invention relates to a drawer arranged to be pulled out from opposite sides of a cabinet wherein the drawer contains a receptacle which is moved toward the outer end of the drawer regardless of the direction in which the drawer is pulled out of the cabinet.

Drawers heretofore proposed for pulling out of opposite sides of a cabinet are unsatisfactory for the storage of small articles. The articles are usually deposited in the front part of the drawer and then when the drawer is pulled out from the opposite side of the cabinet, the articles are relatively inaccessible in the back end of the drawer. Since such drawers are often used alternately from opposite sides of the cabinet, the articles are then frequently at the back end of the drawer when they are wanted.

This is particularly true in a kitchen cabinet which is used as a room divider to separate a kitchen area from a dining area. When silverware is washed, the silverware drawer is opened on the kitchen side of the cabinet and the tendency is to put the cleaned silverware in the front part of the drawer. Then, when the drawer is opened on the dining area side of the cabinet to use the silverware, the articles are relatively inaccessible in the back end of the drawer. This is a constant annoyance in the handling of many small articles of which silverware is just one striking example because such articles are used so frequently.

Objects of the present invention are, therefor, to provide an improved double pull drawer, to provide a more convenient double pull drawer for small articles, and to provide a double pull drawer containing a receptacle which moves toward the outer end of the drawer regardless of the direction in which the drawer is pulled out of its cabinet.

SUMMARY OF THE INVENTION

In the present cabinet construction, a drawer arranged to be pulled out from opposite sides of a cabinet contains a receptacle having half the length of the drawer. The receptacle rides on a roller in the bottom of the drawer which rolls on a supporting surface in the cabinet. The roller moves the receptacle toward the outer end of the drawer regardless of the direction in which the drawer is pulled out of the cabinet.

The invention will be better understood and additional objects and advantages will become apparent from the following description of the preferred embodiment illustrated on the accompanying drawing. Various changes may be made, however, in the details of construction and arrangement of parts and certain features may be used without others. All such modifications within the scope of the appended claims are included in the invention.

BRIEF DESCRIPTION OF THE DRAWING

FIG. 1 is a vertical cross sectional view of a cabinet having a double pull drawer embodying the invention, showing the drawer in closed position;

FIG. 2 is a view similar to FIG. 1 showing the drawer opened to the left; and

FIG. 3 is a view on the line 3—3 in FIG. 1.

DESCRIPTION OF THE PREFERRED EMBODIMENT

By way of example, the drawing illustrates a cabinet 10 which serves as a room divider between a kitchen area on the left and a dining room on the right. The cabinet may have a counter top 11 extending into the kitchen area and the cabinet may, if desired, be incorporated into a wall 12 having an opening above the counter top for passing dishes and food between the two areas. The cabinet has at least one drawer compartment 13 with a bottom wall or floor 14 and below this may be other drawers or a storage compartment 15 accessible from either side by means of doors 16.

Drawer compartment 13 contains a double pull drawer 20 having one end 21 which may be pulled out to the left into the kitchen area and an opposite end 22 which may be pulled out to the right in the dining area. The bottom 23 of the drawer 20 is provided with a transverse opening 24 at mid length containing a roller 25 which rolls on the floor 14 of the drawer compartment. The shaft 26 of roller 25 is mounted in the free ends of a pair of arms 27 which are pivotally mounted at 28 to the bottom 23 of the drawer. Arms 27 provide a vertically movable mounting for roller 25 allowing the roller to move up and down relative to the drawer.

A receptacle 30 half as long as the drawer 20 has a bottom wall 31 resting on roller 25. The opposite ends of receptacle 30 are provided with rollers 32 and 33 to roll on the bottom 23 of the drawer. Receptacle 30 is adapted to contain small articles such as silverware 35 which has been washed in the kitchen area on the left side of the cabinet in preparation for use in the dining area on the right side of the cabinet.

In order to assist in centering the drawer in closed position, the drawer compartment floor 14 may be provided with a depression 36 to receive the roller 25 when the drawer is closed from either side of the cabinet. When drawer 20 is pulled to the left, roller 25 rides up out of depression 36 onto the flat, horizontal surface of floor 14 raising one or the other of receptacle rollers 32 or 33 off the bottom 23 of the drawer, depending on the balance of the weight of the contents of the receptacle.

Then as the drawer is pulled open to the left, roller 25 moves receptacle 30 toward the left or open end of the drawer to make the contents of the receptacle fully accessible when the drawer is pulled half way out of the cabinet as shown in FIG. 2. In this position, receptacle 30 has been moved to the end 21 of the drawer, the right end of the drawer remaining in the cabinet to stabilize the drawer.

When receptacle 30 abuts the end 21 of the drawer in FIG. 2, roller 25 stops rolling and acts as a brake on floor 14 of the drawer compartment to stop the outward movement of the drawer. This braking action may be enhanced by providing roller 25 with a rubberized or other suitable non-skid surface. Also, if desired, transverse depressions 37 and 38 similar to depression 36 may be formed at the opposite ends of floor 14 to stop the roller 25 as receptacle 30 abuts either end 21 or 22 of the drawer.

When drawer 20 is pushed in from its FIG. 2 position, roller 25 returns receptacle 30 to the center of the drawer as shown in FIG. 1. If drawer 20 is then pulled out of the right side of the cabinet, the roller 25 moves receptacle 30 toward the right end 22 of the drawer, the receptacle reaching end 22 when the drawer is pulled out approximately half its length at which time roller 25 acts as a brake and is stopped by depression 38. Thus, regardless of the direction in which the drawer is pulled out from the cabinet, receptacle 30 is always in the open end of the drawer making articles in the receptacle conveniently available.

Although it may seem that the present arrangement provides an inefficient use of the drawer space because half of that space is not being used, the entire space in a conventional double pull drawer cannot be utilized effectively in any event without the great inconvenience of having small articles in a relatively inaccessible position at the back end of the drawer. A presumed efficient filling of an entire conventional drawer still makes for inefficiency in the use of the conventional drawer on opposite sides of the cabinet and is an inefficient drain on the nervous energy of the user which is overcome by the present invention.

What is claimed is:

1. In a kitchen cabinet and the like having a drawer arranged to be pulled out from opposite sides of the cabinet, said drawer having bottom and side walls and having opposite end walls each equipped with a handle for pulling the drawer in said opposite directions, a receptacle in said drawer having a bottom wall, said receptacle being half the length of said drawer, and opening at mid length in the bottom of said drawer, a roller mounted on said drawer for rotation in said opening, and a supporting surface in said cabinet for the under side of said roller, said bottom wall of said receptacle resting on the upper side of said roller to shift said receptacle toward the outer end of said drawer when said drawer is pulled in either direction out of said cabinet, said receptacle being confined at all times within said drawer and said receptacle being at the outer end of said drawer when the drawer is pulled half way out of said cabinet.

2. A cabinet as defined in claim 1, said supporting surface comprising a floor in a drawer compartment for said drawer.

3. A cabinet as defined in claim 1, said roller being movable vertically in said opening.

4. A cabinet as defined in claim 3, said roller being mounted on pivotal arms on said drawer.

5. A cabinet as defined in claim 1, said opening and roller extending across the width of said receptacle.

6. A cabinet as defined in claim 1 including rollers on the ends of said receptacle arranged to roll in said drawer, said driving roller elevating said end rollers on one end of said receptacle out of contact with said drawer.

7. A cabinet as defined in claim 1 including stop means preventing said drawer from being pulled more than half way out of either side of said cabinet.

8. A cabinet as defined in claim 7, said stop means being engaged by said roller.

9. A cabinet as defined in claim 8, said stop means comprising transverse depressions in the ends of said supporting surface for said roller.

10. A cabinet as defined in claim 9 including a transverse depression at mid length in said supporting surface to receive said roller and hold said drawer in closed position.

* * * * *